US007128042B2

(12) United States Patent
Giuliani

(10) Patent No.: US 7,128,042 B2
(45) Date of Patent: Oct. 31, 2006

(54) INTERCHANGEABLE 2-STROKE OR 4-STROKE HIGH TORQUE POWER ENGINE

(76) Inventor: Robert Louis Giuliani, 1456 Thurston Ave. A-1204, Honolulu, HI (US) 96822

( * ) Notice: Subject to any disclaimer, the term of this patent is extended or adjusted under 35 U.S.C. 154(b) by 0 days.

(21) Appl. No.: 11/282,794

(22) Filed: Nov. 19, 2005

(65) Prior Publication Data

US 2006/0207544 A1 Sep. 21, 2006

Related U.S. Application Data

(63) Continuation-in-part of application No. 11/083,789, filed on Mar. 18, 2005, now abandoned, which is a continuation-in-part of application No. 10/935,402, filed on Sep. 7, 2004, which is a continuation-in-part of application No. 10/643,274, filed on Aug. 18, 2003, which is a continuation-in-part of application No. 10/252,927, filed on Sep. 24, 2002.

(51) Int. Cl.
*F02B 75/32* (2006.01)

(52) U.S. Cl. ..... 123/197.1; 123/197.5

(58) Field of Classification Search ..... 123/21, 123/55.2, 55.4–55.7, 197.1, 197.5
See application file for complete search history.

(56) References Cited

U.S. PATENT DOCUMENTS 2,482,136 A * 9/1949 Wright ..... 123/197.5
5,673,665 A * 10/1997 Kim ..... 123/197.5

* cited by examiner

*Primary Examiner*—Noah P. Kamen

(57) ABSTRACT

This invention is a fuel efficient, high torque power, offset piston engine. The basic invention is a 2-stroke 2-cylinder engine. A single idler gear provides ignition timing between a pair of out-of-phase power pistons as 1-way clutches transmit the power to the engine's power shaft. Displacing and replacing a special idler changes the engine between a 2 stroke and a 4 stroke. Power stroke overlap saves fuel. Deactivating pistons when not needed without load on the engine saves more fuel. Other benefits will be obvious upon perusing the disclosure.

7 Claims, 5 Drawing Sheets

INTERCHANGEABLE 2-STROKE OR 4-STROKE HIGH TORQUE POWER ENGINE

CROSS-REFERENCE TO RELATED APPLICATIONS

This is a continuation-in-part application of CIP application Ser. No. 11/083,789 filed Mar. 18, 2005 now abandoned which is a CIP of Ser. No. 10/935,402 filed Sep. 7, 2004 which is a CIP of Ser. No. 10/643,274 filed Aug. 18, 2003 which is a CIP of the original application Ser. No. 10/252,927 filed Sep. 24, 2002.

FEDERALLY SPONSORED RESEARCH OR DEVELOPMENT

Not applicable.

BACKGROUND OF THE INVENTION

Engines that transmit an offset piston's power to a straight power shaft have been attempted since at least 1921, e.g. U.S. Pat. No. 1,365,666 but have not had practical success though they inherently offer high torque and high fuel efficiency. Their weakness lies in using many energy absorbing moving parts and combustion chambers to convert the piston's reciprocating rectilinear motion to the power shaft's unidirectional rotary motion which has made them inefficient and impractical, e.g. U.S. Pat. Nos. 2,239,663; and 5,673,665. For this reason, the simple, exhaust polluting, inefficient but reliable crankshaft engine survives as the search for a better power source continues.

Enormous funds and research have been poured into fuel cells, electric vehicles and crank engine hybrids for years to replace the ubiquitous crank engine.

The crank engine is very inefficient because the two angles at both ends of the connecting rod of length L and the crank angle α (FIG. 10) combine to slow the piston's speed, which traps the very rapidly expanding combustion gases in a small chamber. The gases build up very high heat and pressure at and near tdc. Here, nearly all the force from the pressure is vectored against the crankshaft's bearings instead of rotating it. Parts inertia is combined with extra fuel on each power stroke to overcome the angles' resistance. The result is excess exhaust pollution and waste heat. The waste heat is lost and the pollutants are partly scrubbed from the exhaust when it is too late.

A higher rpm increases efficiency but that has reached its limit and it is not good enough. The pollution and the waste heat must be reduced in the combustion chamber by converting them to mechanical motion with a more complete burn. To do that, all the rod and crank angles must be zero during the entire power stroke but that is impossible in a crank engine. The following mathematics explain why:

FIG. 10 is a schematic that represents a crank engine. FV1, FV2, FV3 are force vectors that come from burn pressure driving the piston 38. FV1 is along a radial of the crankshaft axis C. Only FV3, being tangent to the crank circle d, rotates the shaft where FV3=FV1(Cos θ)(Cos Φ). The crank engine's efficiency is zero at tdc when angle θ=0 but angle Φ=90°, making FV3=FV1(1)(0)=0. When FV2 is tangent to circle d, Cos Φ=1.0 and Tan θ=r/L and $\theta=\mathrm{Tan}^{-1}r/L$ from which Cos θ is found. The efficiency at that point is FV3/FV1=Cos θ. The importance of angle $\theta=\mathrm{Tan}^{-1}r/L$ is explained below.

The ratio of the displacement M along the crank circle d to the piston's displacement a at any chosen crank angle θ is easily found from FIG. 10. r is the crank arm length and α is in degrees:

$$r=b+a$$

$$a=r(1-\mathrm{Cos}\ \alpha)$$

$$M=\pi\alpha r/180$$

$$M/a=\pi\alpha/[180(1-\mathrm{Cos}\ \alpha)]$$

For instance, when α=10°, M/a=11.49:1. At this point, the rod's slow crank end must go 11.49 times as far as the piston. The slower the crank's rotation, the longer the gases are trapped in a small chamber and the lower the engine's efficiency. It is known that this is where the confined hot, pressurized gases create most of the pollution and waste heat. The crank's angular efficiency:

$$\mathrm{Cos}\ \theta=FV2/FV1$$

$$\mathrm{Cos}\ \Phi=FV3/FV2$$

$$FV2=FV1(\mathrm{Cos}\ \theta)$$

$$FV2=FV3/\mathrm{Cos}\ \Phi$$

$$FV3=FV1(\mathrm{Cos}\ \theta)(\mathrm{Cos}\ \Phi)$$

$FV3/FV1=(\mathrm{Cos}\ \theta)(\mathrm{Cos}\ \Phi)$ Crank engine's angular efficiency. It caps thermal efficiency.

FIG. 10 is also the basis for the following indented equations that lead to the Cos θ and Cos Φ equations in terms of crank angle α, length L and crank arm r:

$$180-\beta=\gamma$$

$$\gamma+\theta+\Phi=180$$

$\beta=\mathbf{90}-\alpha$ Note the rt. triangle $(\alpha+\beta+90)$ $$180-(90-\alpha)=\gamma \text{ or } 90+\alpha=\gamma$$

$$(90+\alpha)+\theta+\Phi=180$$

$$\alpha+\theta+\Phi=90$$

$$n=r\ \mathrm{Sin}\ \alpha$$

$$\mathrm{Sin}\ \theta=(r/L)\mathrm{Sin}\ \alpha$$

$$\theta=\mathrm{Sin}^{-1}[(r/L)\mathrm{Sin}\ \alpha]$$

$$\mathrm{Cos}\ \theta=\mathrm{Cos}\{\mathrm{Sin}^{-1}[(r/L)\mathrm{Sin}\ \alpha]\}$$

$$\alpha+\mathrm{Sin}^{-1}[(r/L)\mathrm{Sin}\ \alpha]+\Phi=90$$

$$\Phi=90-\{\alpha+\mathrm{Sin}^{-1}[(r/L)\mathrm{Sin}\ \alpha]\}$$

$$\mathrm{Cos}\ \Phi=\mathrm{Cos}(90-\{\alpha+\mathrm{Sin}^{-1}[(r/L)\mathrm{Sin}\ \alpha]\})$$

The equations Cos θ, Cos Φ are easily solved with a hand calculator.

The importance of angle $\theta=\mathrm{Tan}^{-1}r/L$ now follows. That is when FV2 is tangent to the circle d at the arm r which makes angle Φ=0.0 and Cos Φ=1.0. The angular efficiency is Cos $\theta=\mathrm{Cos}(\mathrm{Tan}^{-1}r/L)$. Extend L relative to r so that angle θ goes to 0.0. Then $$^{1}\lim_{\theta \to 0.0} \cos\theta = 1.0.$$

That makes the angular efficiency FV3/FV1=Cos θ)(Cos Φ)=(1)(1)=100% because there is no angular resistance since the angles θ, Φ disappear. The variable angle α disappears. The crank arm r disappears. The variable length torque arm n (FIG. 10) which requires torque buildup is replaced by the fixed length torque arm r' (FIG. 11) which gives instant peak torque.

[1] This is the foundation for calculus.

Unlike the crank, FV1 in this invention (FIG. 11) is always directed to rotating the output shaft 8 rather than directed against the shaft's bearings. FV1 is transmitted with both angles θ, Φ=0.0 through the entire power stroke. The M/a=1:1 through the entire stroke. The circumference d' replaces the crank circle d in FIG. 10. Shaft 8 receives shear force alone from the fixed length torque arm r'.

BRIEF SUMMARY OF THE INVENTION

This is an offset piston engine that can be easily switched between a 2-stroke and a 4-stroke. A pair of power pistons is connected through a single idler timing gear. Each piston is in its combustion cylinder with related parts, including 1-way clutches, to make the basic 2-stroke engine. A third idler connects two basic engines to make a 4-stroke engine. Computer controlled ignition between two basic 2-stroke engines allows power stroke overlap. The crankshaft is replaced by a straight power shaft.

One of the benefits of this engine is overlapping power strokes. For example: a 2-stroke 4 cyl engine with an 8" piston stroke (there is no mechanical limit to the stroke) would simultaneously have the $1^{st}$ piston 4" after tdc and the $2^{nd}$ piston igniting at tdc. The power added by the $2^{nd}$ piston is reduced by the remaining power of the $1^{st}$ piston resulting in fuel savings and smooth shaft rotation. FIG. 9 illustrates power stroke overlap between a pair of 2-stroke engines.

Objects of this invention:

1. fuel efficient;

2. a single efficient idler for timing between out-of-phase pistons;

3. interchange able between 2-stroke and 4-stroke;

4. no mechanical limit to the piston stroke;

5. instant peak torque at the beginning of the power stroke;

6. power stroke overlap;

7. pistons square in the cylinders;

8. deactivating (stopping) pairs of pistons when not needed without load on the engine.

DETAILED DESCRIPTION OF THE INVENTION

Figure 1:
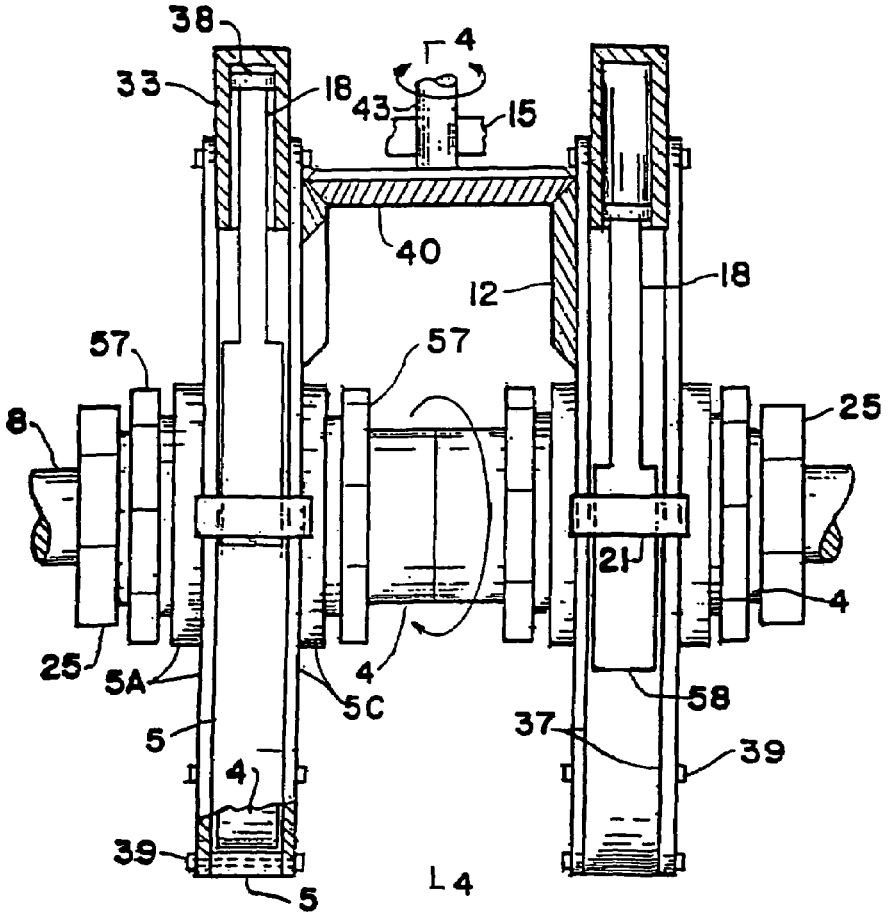
FIG. 1 is a view of the basic 2-cylinder 2-stroke engine with a single timing gear.

This invention uses a single idler gear 40 for ignition timing between two offset pistons 38. The basic 2-stroke 2-cylinder engine uses a pair of 1-way clutches, each carrying a gear 12 that meshes with the single idler gear (FIG. 1) as the 1-way clutches transmit piston power to power shaft 8. There can be more than one basic engine positioned along the straight power shaft. Two basic engines can be combined through a special idler gear 40A (FIG. 8) to create a 4-stroke engine.

Two engine configurations are described in which the piston is square in the cylinder. Shear force is applied to power shaft 8 which permits smaller main bearings.

Figure 3:
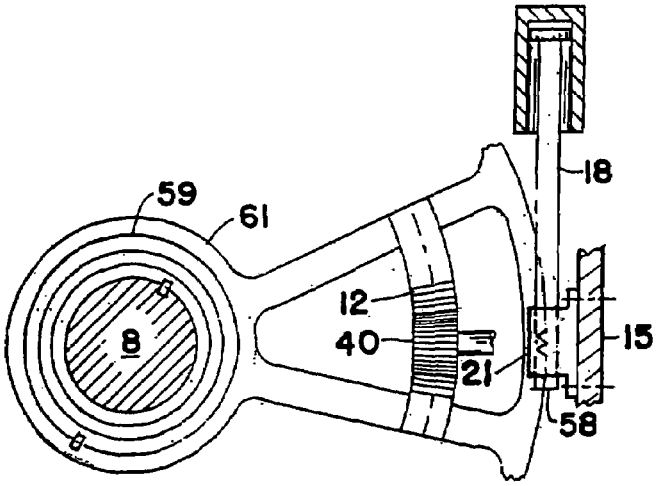
FIG. 3 shows a combination rack gear and conventional 1-way clutch.
Figure 4:
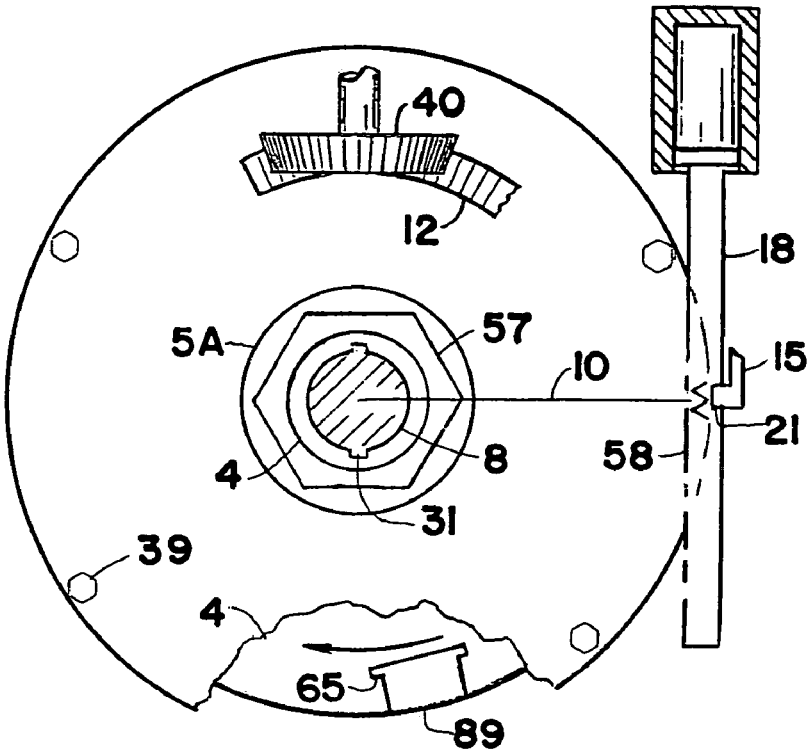
FIG. 4 is a view essentially along 4—4 in FIG. 1.

One configuration of this engine uses a rack gear 58 to transmit power between piston rod 18 and the 1-way clutch outer race 5 (FIGS. 3,4). A suitable guide 21, secured to housing 15, keeps the rack 58 aligned with the outer race 5. A second configuration (FIG. 6) uses an arc shaped cylinder 33 with a direct connection between the piston rod 18 and the 1-way clutch outer race 5 which eliminates the rack gear and the guide. A third configuration described in an earlier application Ser. No. 10/935,402 filed Sep. 7, 2004 uses a belt between the piston and race 5. All transmit the power perpendicular to the piston offset 10 to give instant peak torque at the beginning of the power stroke.

Figure 6:
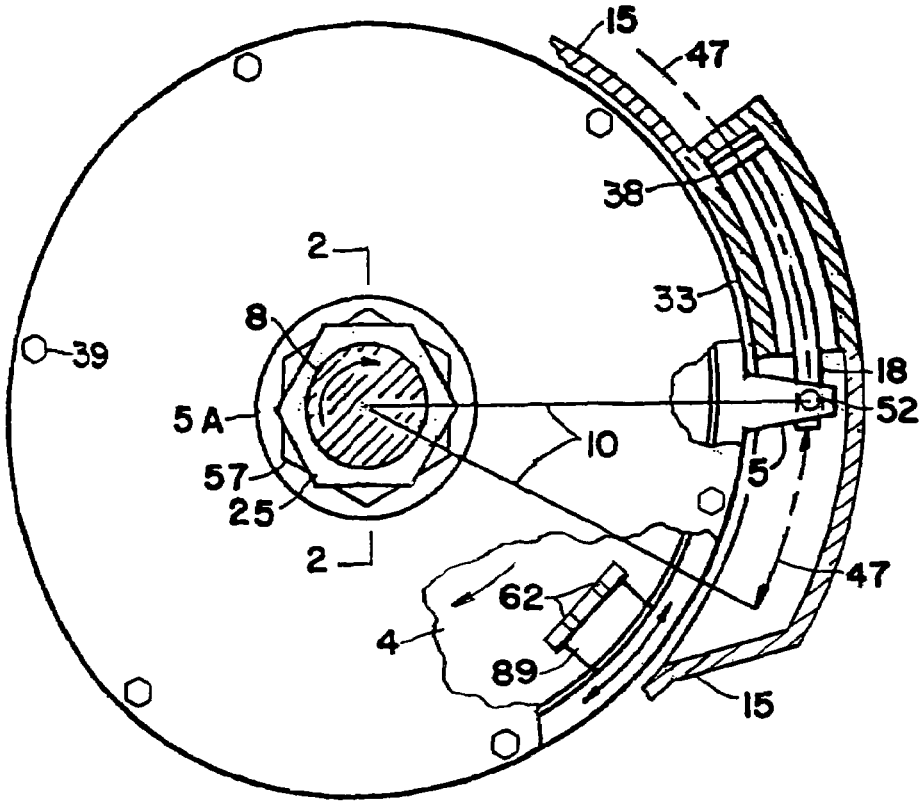
FIG. 6 has an arc center line through the cylinder, piston, piston rod and 1-way clutch outer race.
Figure 7:
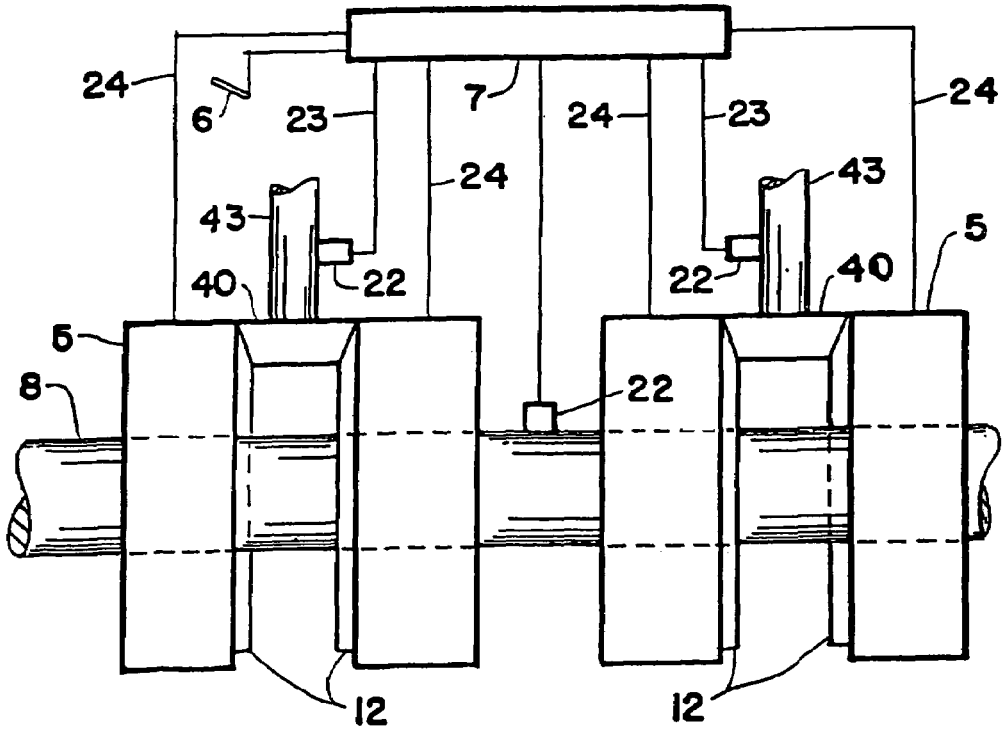
FIG. 7 is a rough schematic of two engine computer controlled pairs of pistons for a 2-stroke.

An arc 47 in FIG. 6 is centered on the shaft 8 axis. Its radius equals the length of the piston offset 10 that is also centered on the shaft 8 axis. This arc is the center line for the combustion cylinder 33, piston 38, piston rod 18, and pin 52. Pin 52 secures rod 18 directly to race 5. The dashed part of arc 47 is the length of the piston stroke. Cylinder 33 is secured to housing 15 with a space between it and outer race 5. The force vector of the expanding combustion gases is tangent to the arc 47 during the entire piston stroke which maximizes efficiency. This configuration is compact and has the benefits of the rack and pinion in FIG. 4, including the efficiency, but the rack and pinion and guide 21 are absent.

An engine computer 7 monitors input from the throttle 6 and shaft power from the sensor 22 on shaft 8 to determine the size of the combustion charge to transmit to the cylinders through injector lines 24. The position of piston 38 is monitored through sensors 22 on shaft 43 and used for ignition timing. By monitoring the motion of each shaft 43 in several independent 2-stroke pairs, the computer controls timing between them. The computer begins a power stroke with a piston in one pair when a piston in another pair is partly through its power stroke (FIG. 9).

Interchanging 4-Stroke and 2-Stroke

Figure 8:
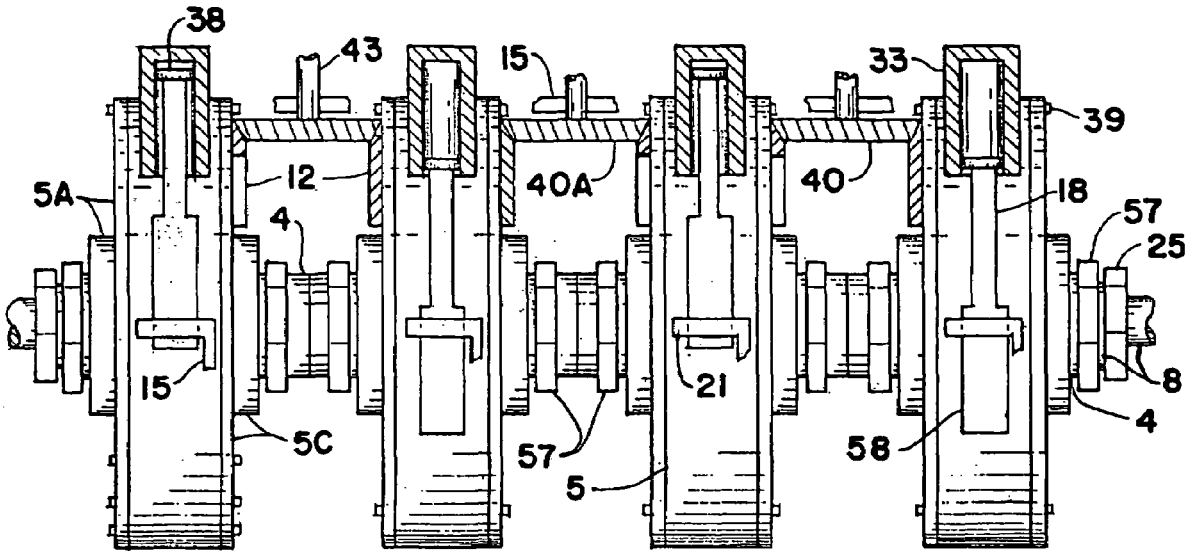
FIG. 8 shows a 4-stroke engine by combining two 2-stroke pairs with a special idler 40A.
Figure 9:
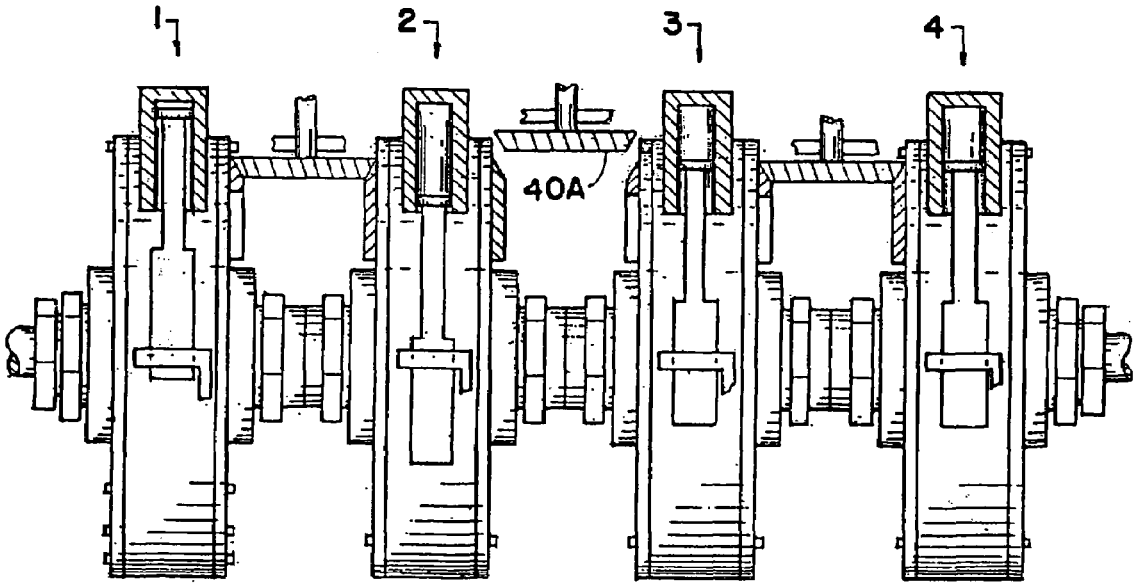
FIG. 9 focuses on separation of idler 40A in FIG. 8 to create two 2-stroke engines.
Figure 10:
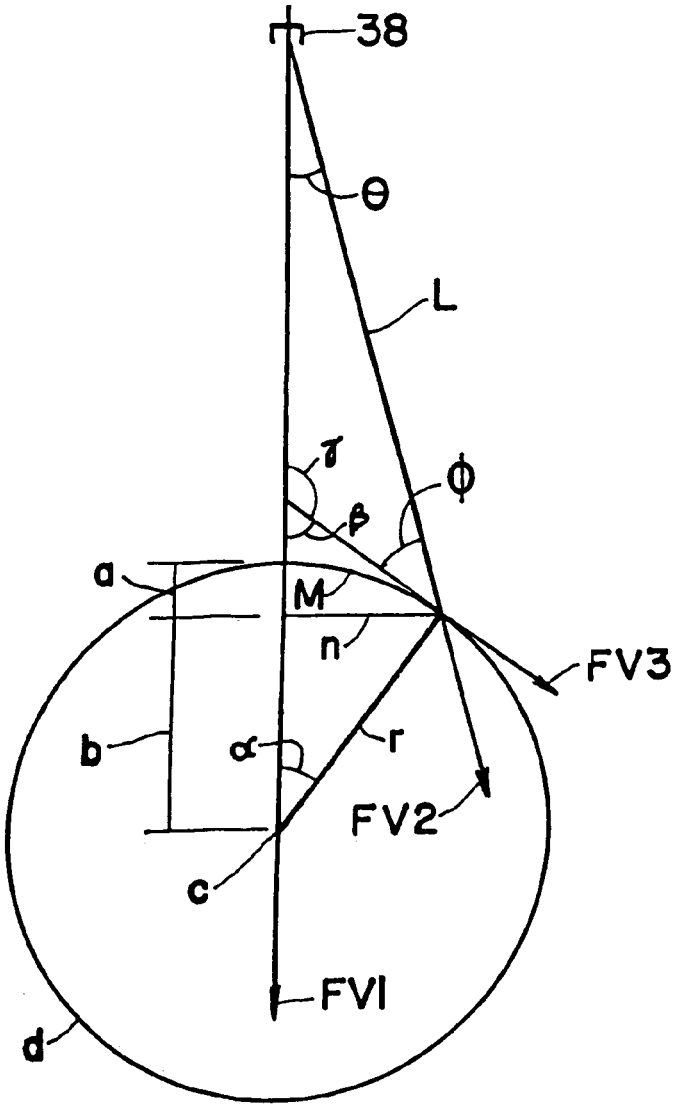
FIG. 10 PRIOR ART
FIG. 10 is a schematic of a crank engine used for mathematical reference in the text above.
Figure 11:
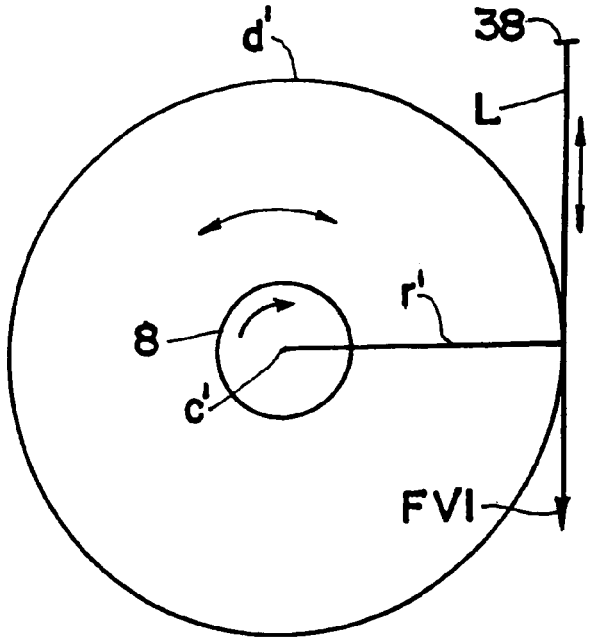
FIG. 11 is a schematic of this invention used to compare with FIG. 10.

The arc centered configuration in FIG. 6 and the rack configuration (FIGS. 1,4) use this feature, shown with a rack gear in the referenced FIGS. 8,9.

In a 4-stroke, a sector gear 12 on each of two pairs engages idler 40A (FIG. 8). When changing from a 2-stroke to a 4-stroke, the pistons are correctly positioned before engaging idler 40A with the sector gears 12. One of the correct positions places two pistons, e.g. power and intake at top dead center and the compression and exhaust positions at bottom dead center as shown in FIG. 8.

To change from a 4-stroke to a 2-stroke, the special idler 40A is disengaged from sector gears 12. One of the relative positions of the active pistons under computer 7 control is shown in FIG. 9. Cylinder 1 begins its power stroke. Cylinder 2 begins its exhaust, intake stroke. Cylinder 3 is ½ way through its power stroke. Cylinder 4 is ½ way through its exhaust, intake stroke. 50% power stroke overlap and smooth rotation of the shaft 8 is gained. One pair of pistons can be deactivated (stopped) without load on the engine to continue with a basic 2-stroke 2-cylinder engine.

1-Way Clutches

FIG. 3 shows a gear 61 secured to a conventional 1-way clutch 59. The clutch is secured to the power shaft 8 with torque transmitting cams close to the shaft 8 axis where maximum force is applied to them. A rack gear 58, part of piston rod 18, powers gear 61 which rotates shaft 8 through the clutch 59. A sector gear 12 meshes with idler gear 40 and idler 40 meshes with a second gear 12 carried by a second gear 61 (not shown) to timely advance the second out-of-phase piston on its stroke. The guide 21, secured to housing 15, maintains alignment between the rack and gear 61. There would be less force on the conventional 1-way clutch cams if they were carried by a unit 89 cartridge in a recess at the rim of a radially extended inner race 4.

My U.S. Pat. No. 6,571,925 titled, "1-Way Clutch That Uses Levers" describes a 1-way clutch which is modified to fit this engine by securing two side plates 5A and 5C to the outer race 5 with bolts 39. The plates secured to two clutches carry a sector gear 12 that meshes with opposite sides of idler 40 (FIGS. 1,4) to make the basic 2-stroke engine in this invention. Sealant gaskets 37 between race 5 and the side plates protect the clutch internal working parts from oil.

Figure 2:
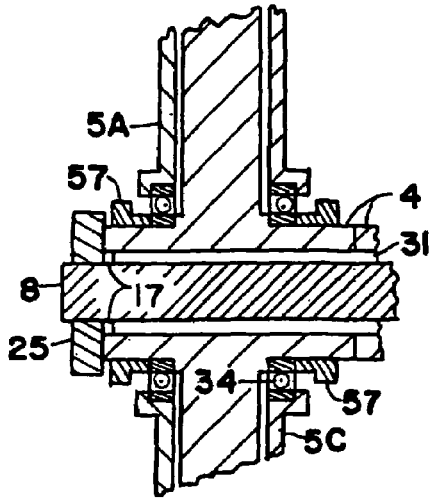
FIG. 2 is a view along line 2—2 in FIG. 6.

The modified 1-way clutch has torque transmitting units 89 in a recess at the rim of inner race 4 (FIGS. 4,6). This distance from the shaft 8 axis reduces force on the unit 89 working parts which contributes to a longer operational life and allows indexing at a high cpm. The inner race 4 is splined 31 to the power shaft 8 (FIG. 2) and rotates in one direction.

Retaining nuts 25, threaded to both ends of shaft 8, prevent axial movement of the 1-way clutch assemblies. The diameter of the shaft's two threaded end parts extends only to the base of the splines 31 to create a narrow space 17 between nut 25 and the splines so that total nut 25 force is applied to race 4 at both shaft ends. There are two retaining nuts 57 for each race 4 that are threaded to the part of race 4 that extends along shaft 8. Nuts 57 apply force to the inner race of each bearing 34 so that the bearings' inner races rotate in one direction with race 4. Pressure from plates 5A and 5C cause the outer races of both bearings 34 to index with race 5. Nuts 25 at both shaft ends prevent axial movement. The splines prevent rotational slip. The combined parts operate as a strong, tight, efficient unit.

Figure 5:
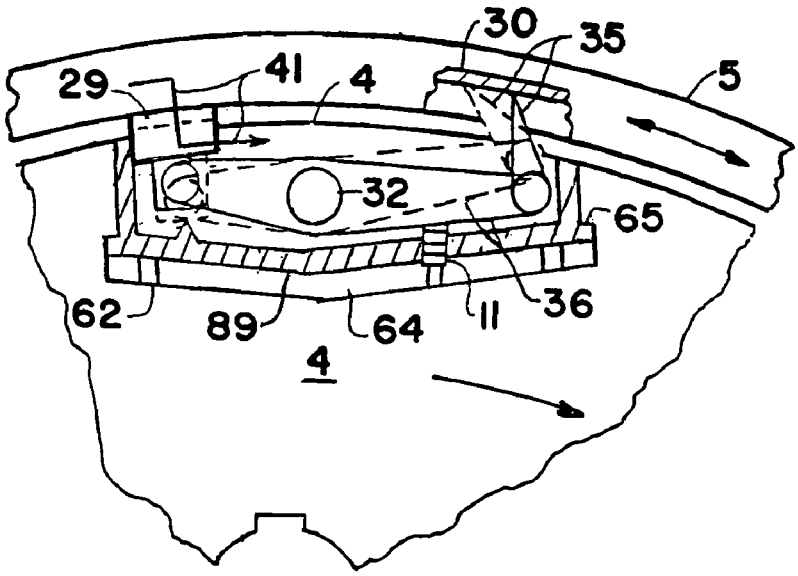
FIG. 5 exposes the working parts of the torque transmitting unit.

FIG. 5 exposes the working parts of unit 89 in the modified clutch. Pin 35 pivots in non-slip contact with band 30 as race 5 begins the drive direction to the right. The pivoting compresses spring 11 which tilts lever 36 on its fulcrum 32 to bring element 29 into contact with outer race 5. Sealant gaskets 37 protect the contact surfaces from oil. Element 29 does not contact band 30. Element 29 and race 5 have contact surfaces with high friction coated V-grooves. A space 64 between unit 89 and race 4 provides the needed clearance between the V-grooves to place unit 89 in the recess on race 4. Unit 89 is then raised to contact the race 4 offset 65 for the correct operating clearance between the two sets of V-grooves. Shims 62 under unit 89 secure the correct operating clearance.

Force vector 41 is transmitted from the outer race 5 directly through element 29 to inner race 4. The force vector can be expected to vary during drive causing pin 35 to instantly adjust its pivot to increase or decrease its contact pressure with the band 30 which instantly adjusts the needed pressure to prevent slip between the contact surfaces of elements 29 and race 5. The lever arms 36 contact unit 89 to prevent spring 11 from excessively pivoting pin 35.

The 1-way clutch overrun feature in this engine allows output shaft 8 and the clutch inner race 4 to rotate independently of the pistons 38 when the race 4 speed is greater than the outer race 5 speed. This feature makes engine braking energy available for regenerated energy. This feature also allows deactivating (stopping) a pair of pistons when not needed without load on the engine. Attempts to deactivate (stop) pistons have been unsuccessful with crankshaft engines for decades.

I claim:

1. An engine comprising:

a pair of work members each including a 1-way clutch comprising a drive race and a driven race, a combustion cylinder, a power piston for reciprocating in said cylinder, a piston rod connected to the piston and transmitting power to the drive race by a first means;

each driven race secured on a power shaft;

an idler located between and driven by the drive races so that the drive races maintain timing between the two pistons that are out of phase.

2. The engine of claim 1 wherein;

said first means comprises an arc centered on the axis of the power shaft;

a force vector stemming from the combustion cylinder and the force vector is tangent to the arc.

3. The engine of claim 1 wherein:

said first means comprises a rack gear at the end of the rod, the rack gear engaging the drive race and a guide maintaining alignment between the rack and the drive race.

4. The engine of claim 1 comprising:

at least two pairs of the work members, a special idler between the pairs wherein disengaging the special idler results in two 2-stroke pairs.

5. The engine of claim 4 wherein engaging the special idler results in a 4-stroke engine.

6. The engine of claim 1 in which said I-way clutch comprises a gear secured to the drive race wherein the idler engages the secured gear.

7. The engine of claim 1 wherein;

said first means comprises a belt wrapped around and connected at one end to the drive race and to the piston rod at its opposite end.

* * * * *